United States Patent [19]

Hashimoto et al.

[11] Patent Number: 4,517,878

[45] Date of Patent: May 21, 1985

[54] SHOCK ABSORBING DEVICE FOR HYDRAULIC CYLINDER

[75] Inventors: Hisayoshi Hashimoto; Morio Tamura, both of Ibaraki, Japan

[73] Assignee: Hitachi Construction Machinery Co., Ltd., Tokyo, Japan

[21] Appl. No.: 410,954

[22] Filed: Aug. 24, 1982

[30] Foreign Application Priority Data

Oct. 20, 1981 [JP] Japan ..... 56-155736[U]
Dec. 16, 1981 [JP] Japan ..... 56-187841[U]
Mar. 10, 1982 [JP] Japan ..... 57-33416[U]

[51] Int. Cl.[3] ..... F15B 15/22
[52] U.S. Cl. ..... 91/396; 92/85 B
[58] Field of Search ..... 91/394, 395, 396, 25, 91/26; 92/85 B

[56] References Cited

U.S. PATENT DOCUMENTS 3,418,888 12/1968 Mercier ..... 91/396
3,704,650 12/1972 Berg ..... 91/396
3,933,080 1/1976 Corrie ..... 91/394
3,964,370 6/1976 Rich ..... 91/395
4,064,788 12/1977 Rich et al. ..... 91/396
4,386,555 6/1983 Horiuchi et al. ..... 91/396

FOREIGN PATENT DOCUMENTS 31539 11/1972 Japan .

*Primary Examiner*—Paul E. Maslousky
*Attorney, Agent, or Firm*—Antonelli, Terry & Wands

[57] ABSTRACT

A shock absorbing device for a hydraulic cylinder including a shock absorbing hole formed in an end wall of cylinder, a passageway having a port opening in the shock absorbing hole at its inner peripheral surface and a shock absorbing member attached to the piston and aligned with the shock absorbing hole so that it enters the hole during shock absorbing stroke. During movement of the shock absorbing member, it throttles the flow of fluid in the hole to perform a first stage shock absorption, then throttles the flow of fluid through the port to perform a second stage shock absorption, and at last compresses the fluid in the bottom of the hole to perform a third stage shock absorption.

6 Claims, 19 Drawing Figures

SHOCK ABSORBING DEVICE FOR HYDRAULIC CYLINDER

BACKGROUND OF THE INVENTION

This invention relates to a shock absorbing device for a hydraulic cylinder capable of imparting to a piston the function of absorbing the force of shocks in a plurality of stages at the terminating portion of a stroke of the piston of the hydraulic cylinder.

In the majority of hydraulic cylinders, it is usual practice to move the piston rod assembly at high speed to increase operation efficiency. The piston rod assembly moving at high speed has high kinetic energy, so that it is necessary to provide means for absorbing high energy of inertia to bring same to a halt at the end of its stroke. If the piston rod assembly were allowed to impinge on the end wall of the cylinder when it is brought to a halt, a high force of impact would be exerted on the end wall to thereby cause considerable damage thereto. Thus, a shock absorbing device for absorbing the energy of inertia possessed by the piston rod assembly has been provided to absorb the force of shocks at the end of the stroke of the piston.

One type of shock absorbing device is disclosed in Japanese patent application Laid-Open No. 35478/72 (corresponding to U.S. application Ser. No. 128,822). This shock absorbing device comprises an axially extending cylindrical shock absorbing port formed in the end wall of the cylinder housing communicating at one end with the cylinder chamber and at the other end with a suction and exhaust passageway, and a cylindrical shock absorbing member mounted on the piston and adapted to be inserted in the shock absorbing port at the end of the stroke of the piston to reduce the area of the channel in the shock absorbing port. The device functions such that high resistance is offered to a stream of working fluid discharged, in the terminating stages of the stroke of the piston, from the cylinder chamber through the shock absorbing port by the piston as the shock absorbing member enters the shock absorbing port, to thereby restrict the flow rate of the discharged fluid to impart a shock absorbing function to the piston. A disadvantage of this proposed device resides in the fact that the effectiveness of the shock absorbing function may vary depending on the relation between the length of the cylindrical portion of the cylindrical shock absorbing member and the length of the shock absorbing port, and to increase the shock absorbing function would require an increase in these lengths. This however, would increase the overall length of the cylinder. Conversely, in the case of a cylinder of restricted cylinder length, it would be necessary to forego the benefit of shock absorbing function. A further disadvantage resides in the fact that the shock absorbing device has a shock absorbing characteristic such that the instant the shock absorbing member enters the shock absorbing port, deceleration of very high order would take place in the piston and no great deceleration would occur thereafter. Stated differently, the device would only perform a shock absorbing function or energy absorbing function in a single stage. Thus, a very high force of impact would be exerted on the hydraulic cylinder the instant the shock absorbing member enters the shock absorbing port, and a high impact force would be applied to the end wall of the cylinder housing when the piston impinges thereon when it is brought to a halt. Another disadvantage resides in the fact that the provision of the axially extending shock absorbing port and the suction and discharge passageway communicating with the end portion of the shock absorbing member in the end wall of the cylinder housing would increase the axial length of the end wall of the cylinder housing. Moreover, it is only in the annular throttling passageway defined between the inner peripheral surface of the shock absorbing port and the outer peripheral surface of the shock absorbing member that the shock absorbing function is performed, so that the clearance between the inner and outer peripheral surfaces constituting the throttling passageway would exert great influences on the shock absorbing performance. Thus, it would become necessary to increase the precision with which working and assembling are performed, which would be troublesome.

SUMMARY OF THE INVENTION

This invention has been developed for the purpose of obviating the aforesaid disadvantages of the prior art. Accordingly, one of the objects of the invention is to provide a shock absorbing device for a hydraulic cylinder which is free from the defects of the shock absorbing device for a hydraulic cylinder of the prior art described in the background of the invention.

Another object of the invention is to provide a shock absorbing device for a hydraulic cylinder operative to absorb the energy of inertia of the piston assembly at least in three stages.

According to an aspect of the present invention, a shock absorbing operation is carried out in three stages. In the first stage of operation, shock absorption is performed as the shock absorbing member movable unitarily with the piston assembly enters the shock absorbing hole formed at one end wall of the cylinder to throttle the flow of a fluid therein, to thereby impart resistance to the fluid flowing in the shock absorbing hole. In the second stage of operation, shock absorption relies on throttling by the shock absorbing member of the area of the opening of the port maintaining the shock absorbing hole in communication with the supply and discharge passageway, so that the fluid flowing through the port is given with resistance. In the third stage of operation, shock absorption is carried out as the shock absorbing member enters the back pressure chamber at the end of the shock absorbing hole to create in the back pressure chamber a back pressure opposing the movement of the shock absorbing member and to impart resistance to the fluid flowing out of the back pressure chamber.

DETAILED DESCRIPTION OF THE PREFERRED EMBODIMENTS

Figure 1:
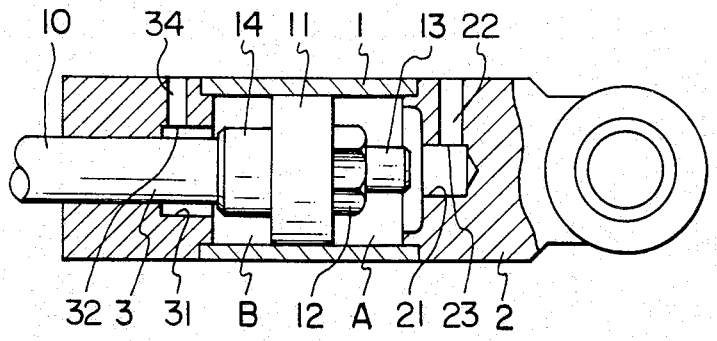
FIG. 1 is a sectional view of a hydraulic cylinder incorporating therein the shock absorbing device comprising one embodiment of the invention.

Referring to FIG. 1, the hydraulic cylinder comprises a cylinder housing including a cylinder 1 and a head cover 2 and a rod cover 3 secured to opposite ends of the cylinder 1. The head cover 2 is formed therein with a shock absorbing hole 21 adapted to receive therein a shock absorbing member subsequently to be described, a port 23 opening in the shock absorbing hole 21 at its side, and a supply and discharge passageway 22 communicating with the port 23. Likewise, the rod cover 3 is formed therein with a shock absorbing hole 31, a port 32 and a supply and discharge passageway 34. The rod cover 3 guides a rod 10 for sliding movement, and the rod 10 has a piston 11 defining hydraulic chambers A and B in the cylinder 1 in which it is slidably fitted. A nut 12 for securing the piston 11 to the rod 10 and the shock absorbing member 13 are located at an end surface of the piston 11 on the head cover 2 side, and another shock absorbing member 14 is located at an end surface of the piston 11 in contact therewith. The shock absorbing members 13 and 14 may be in the form of shock absorbing plungers formed integrally with the rod 10 or piston 11. Alternatively, shock absorbing rings held by the rod 10 through rubber rings may be used.

Figure 2:
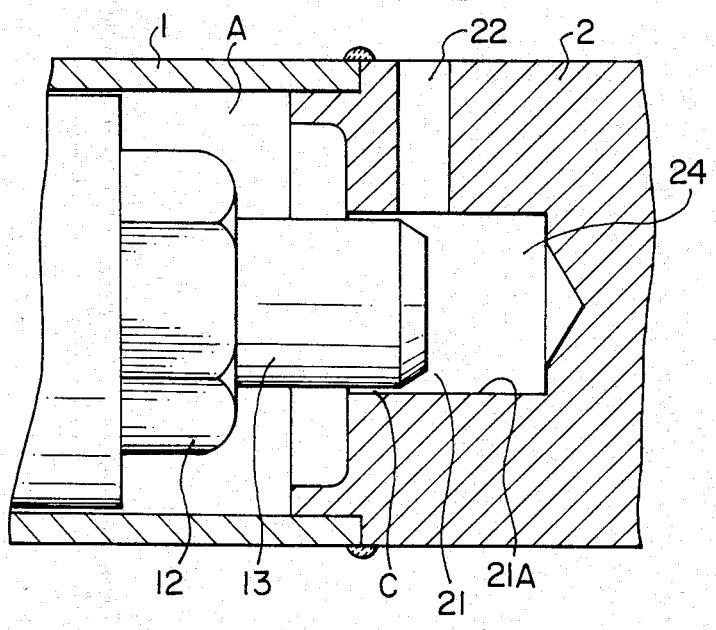
FIGS. 2 and 3 are sectional views showing, on an enlarged scale, the shock absorbing device of FIG. 1 mounted on the head cover side with the piston located in different operation positions.
Figure 3:
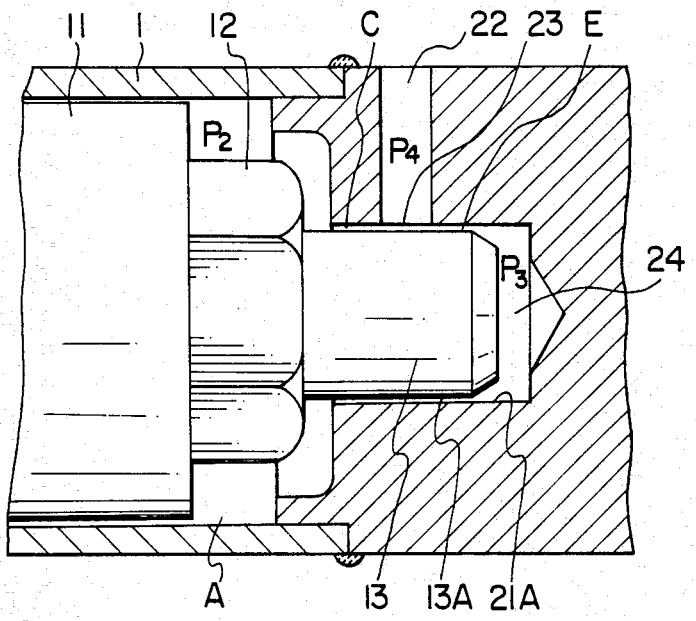

As shown in FIGS. 2 and 3, the shock absorbing hole 21 includes a cylindrical inner peripheral surface 21A at which the port 23 opens in the shock absorbing hole 21. Meanwhile, the shock absorbing member 13 is aligned with the shock absorbing hole 21 and has a cylindrical outer peripheral surface 13A of an outer diameter slightly smaller than the diameter of the inner peripheral surface 21A. Thus, as the shock absorbing member 13 is received in the shock absorbing hole 21, a minuscule annular gap or throttle passageway C is defined between the inner peripheral surface 21A of the shock absorbing hole 21 and the outer peripheral surface 13A of the shock absorbing member 13. The shock absorbing hole 21 extends farther than the port 23 to form a back pressure chamber 24. Meanwhile the shock absorbing member 13 is constructed such that, as shown in FIG. 3, the forward end of the cylindrical outer peripheral surface 13A moves past the port 23 to enter the back pressure chamber 24 at the end of a stroke of the piston and cooperates with the inner peripheral surface 21A of the shock absorbing hole 21 to define adjacent and posterior to the port 23 a minuscule annular gap or annular throttle passageway E. The annular throttle passageway E functions such that when the shock absorbing member 13 enters the back pressure chamber 24, the pressure fluid in the latter is restricted in its flow to the port 23 to thereby generate a pressure in the back pressure chamber 24.

Figure 4:
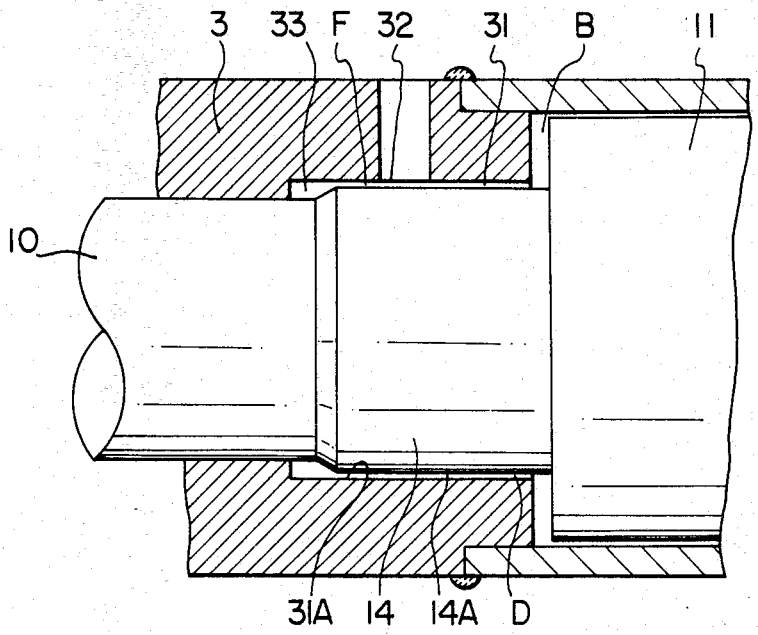
FIG. 4 is a sectional view showing, on an enlarged scale, the shock absorbing device of FIG. 1 mounted on the head cover side.

Likewise, as shown in FIG. 4, the shock absorbing hole 31 formed in the rod cover 3 includes a cylindrical inner surface 31A, and the shock absorbing member 14 includes a cylindrical outer peripheral surface 14A. The shock absorbing member 14 is constructed such that the forward end of the outer peripheral surface 14A moves across a port 32 opening at the cylindrical inner surface 31A into a back pressure chamber 33 so that minuscule annular gaps D and F are defined on opposite sides of the port 32 by the outer peripheral surface 14A and the inner peripheral surface 31A.

Operation of the shock absorbing device shown and described hereinabove will be described. Upon a pressure fluid being fed into the chamber B from the supply and discharge passageway 34 via the port 32, the piston 11 moves rightwardly in the figure at high speed in a compression stroke and enters a shock absorbing stroke, in which the forward end of the shock absorbing member 13 enters the shock absorbing hole 21 to define the annular throttle passageway C between the inner peripheral surface 21A of the shock absorbing hole 21 and the outer peripheral surface 13A of the shock absorbing member 13. This throttles the flow of the pressure fluid from the chamber A to the supply and discharge passageway 22 via the shock absorbing hole 21, so that a high pressure prevails in the chamber A to offer high resistance to the movement of the piston 11. At the same time, the resistance offered by the flow of the pressure fluid through the throttle passageway C is conducive to rapid deceleration of the piston 11. Then, a shock absorbing function mainly attributed to resistance to the flow offered by the throttle passageway C is performed, and the piston 11 shows slow deceleration. During this shock absorbing operation, the shock absorbing member 13 continues its movement into the shock absorbing hole 21 and the length of the annular throttle passageway C increases with an attendant increase in the resistance offered to thereby the flow of the pressure fluid. However, the deceleration of the piston 11 is not so high. This deceleration condition continues until the shock absorbing member 13 reaches a position (shown in FIG. 2) in which the forward end of the shock absorbing member 13 is positioned against the port 23.

Further movement of the shock absorbing member 13 into the shock absorbing hole gradually reduces the area of the opening of the port 23 as it is closed by the outer peripheral surface 13A of the shock absorbing member 13. This creates a high resistance offered to the pressure fluid as it flows through the port 23 into the supply and discharge passageway 22 from a space 24 in the hole 21 after it has flown through the annular throttle passageway C into the space 24, to thereby decelerate the piston 11. The flow resistance offered by the port 23 grows by leaps and bounds as the area of the opening of the port 23 is reduced, so that the piston 11 shows a rapid deceleration. The shock absorbing member 13 continues its movement into the shock absorbing hole 21 even after the former has fully closed the port 23, to generate a high pressure in the back pressure chamber 24, which offers resistance to the movement of the shock absorbing member 13 into the shock absorbing hole 21. Combined with the resistance offered by the high pressure in the back pressure chamber 24, the resistance offered by the throttle passageway E to the flow of the pressure fluid from the back pressure chamber 24 through the throttle passageway E to the port 23 decelerates the piston 11 further. Thus, according to the present embodiment, it is possible to decelerate the piston 11 until its speed is reduced to a very low level by a shock absorbing operation performed in three stages, shock absorption in the first stage being performed by the action of the throttle passageway C, shock absorption in the second stage being performed by the throttling action of the passageway C and the port 23, and shock absorption in the third stage being performed by the back pressure in the back pressure chamber 24 and the throttling action of the passageway E in addition to the throttling action of the passageway C and the port 23. It should be noted that the length of the throttle passage E offering the third stage shock absorption is exaggeratedly shown in the figures, as compared with the length of the throttle passage C and the width of the port 23, and may be extremely smaller than the length of the passage C and the width of the port 23.

Figure 5:
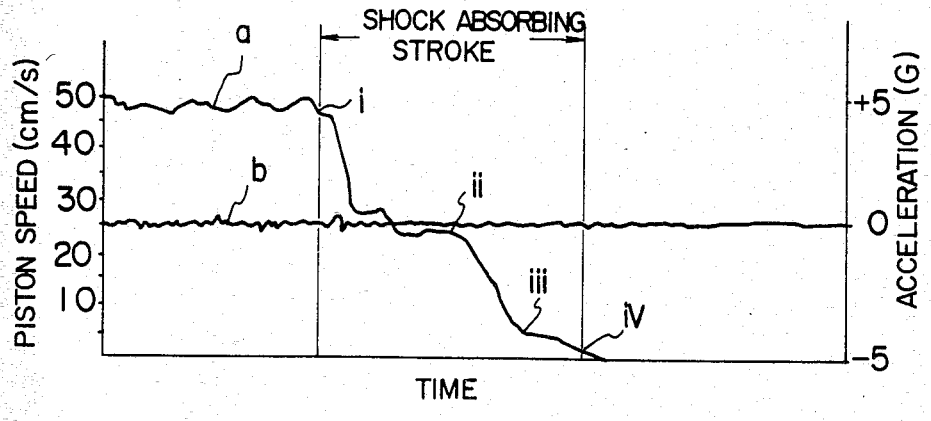
FIG. 5 is a graph showing the piston speed and the head cover acceleration in the shock absorbing stroke of the embodiment shown in FIGS. 2 and 3.
Figure 6:
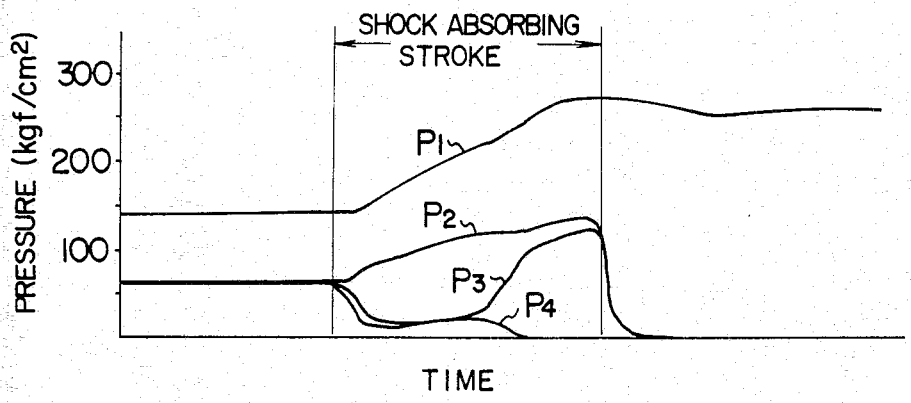
FIG. 6 is a diagrammatic representation of the pressure characteristic of the embodiment shown in FIGS. 2 and 3 exhibited in the shock absorbing stroke.

In FIG. 5, a curve (a) represents a change in piston speed, and points, i, ii, iii and iv indicate positions in which shock absorption is initiated immediately before the shock absorbing member 13 enters the shock absorbing hole 21, the shock absorbing member 31 begins to close the port 23 of the suction and discharge passageway 22, the shock absorbing member 13 has completely closed the port 23 and the piston 11 has reached the end of its stroke, respectively. Meanwhile, a curve (b) represents a change in the acceleration of the head cover 2. In FIG. 6, $P_1$, $P_2$, $P_3$ and $P_4$ represent the internal pressure of the hydraulic chamber B (see FIG. 1), the internal pressure of the hydraulic chamber A, the internal pressure of the back pressure chamber 24 and the internal pressure of the supply and discharge passageway 22 (see FIG. 3) respectively. In the graphs shown in FIG. 5, a section i–ii represents a first stage shock absorption in which the internal pressure $P_2$ of the chamber A gradually rises and offers resistance to the piston 11 while the latter is decelerated by the throttling action of the throttle passageway C. A section ii–iii represents a second stage shock absorption in which in addition to the aforesaid shock absorption offered by the throttle passageway C, the port 23 of the suction and discharge passageway 22 is gradually throttled and the piston is decelerated. A section iii–iv represents a third stage shock absorption in which, following full closure of the port 23, the back pressure $P_3$ is produced in the back pressure chamber 24 to decelerate the piston 11.

Figure 7:
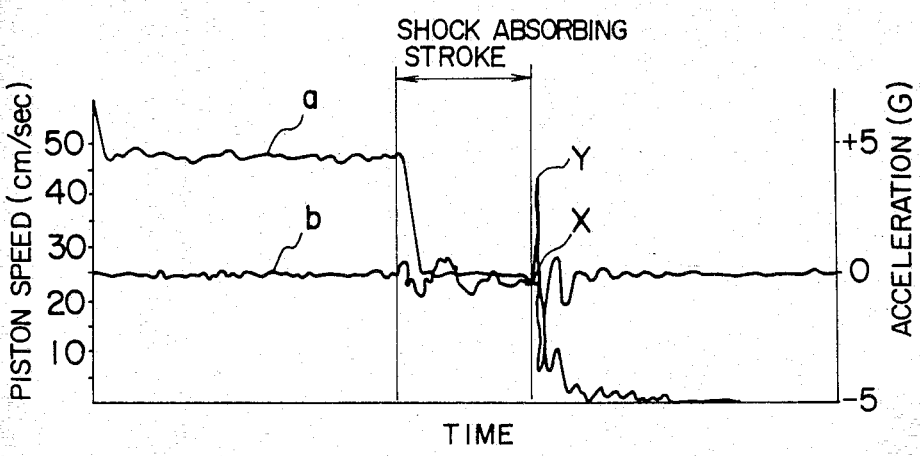
FIG. 7 is a graph showing the piston speed and the head cover acceleration of a shock absorbing device of the prior art in the shock absorbing stroke.

As shown in FIG. 7, a curve (a) represents a change in the speed of the piston, and a curve (b) indicates a change in the acceleration of the head cover 2. In FIG. 7, it will be seen that in the shock absorbing device of the prior art, shock absorption is performed only in one stage and that even at the end of a shock absorbing operation, the piston still has a substantial speed as indicated at a point X. The piston is brought to a halt at the end of its stroke by impinging on the head cover, so that a high force of impact is exerted on the head cover and high acceleration is generated in the head cover as indicated at a point Y. To the contrary, in the embodiment shown in FIGS. 2 and 3 smooth deceleration of the piston 11 can be obtained as shown in FIG. 5 and a good shock absorbing characteristic is exhibited. The change in the acceleration of the head cover 2 is almost nil as indicated by the curve (b), indicating that no high force of impact is exerted thereon. Even in the shock absorbing device of the prior art in which shock absorption is performed only by the annular throttling passageway C, it is possible to reduce the speed of the piston satisfactorily at the end of its stroke. However for the purpose, one has to reduce the gap between the shock absorbing member and the shock absorbing hole or the width of the throttle passageway C and increase its length. This would entail an increase in the overall length of the cylinder and make it necessary to increase the precision with which machining and assembly of the parts are performed. In addition, the shock absorbing device of the prior art thus improved has a shock absorbing characteristic such that the speed of the piston is reduced abruptly at the beginning of shock absorbing stroke. Thus, it will be appreciated that the embodiment of the present invention is superior to the device of the prior art in that a better shock absorbing characteristic is obtained without requiring to increase the precision of machining and assembling of the parts and to increase the length of the cylinder.

The aforesaid description refers to the shock absorbing device mounted on the head cover 2 side. The shock absorbing device mounted on the rod cover 3 side and shown in FIG. 4 operates in like manner, so that the description thereof shall be omitted.

In the embodiment shown and described hereinabove, the inner peripheral surface of the shock absorbing hole and the outer peripheral surface of the shock absorbing member are both cylindrical in shape. However, the invention is not limited to this specific shape and one or both of them may be tapering. The use of a tapering inner peripheral surface and/or an outer peripheral surface causes a reduction in the cross-sectional area of the annular gap defined therebetween as the shock absorbing member progressively enters the shock absorbing hole, thereby increasing the shock absorbing effect.

Figure 8:
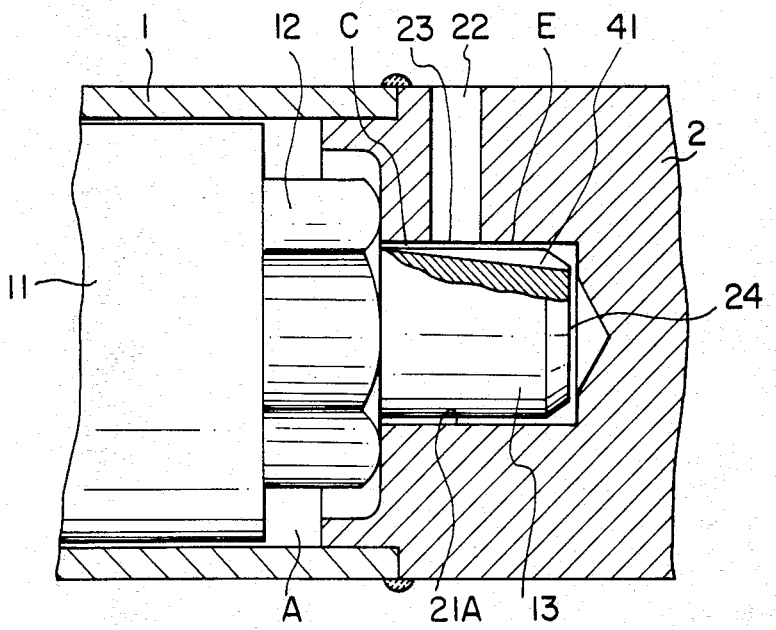
FIGS. 8 and 9 are sectional views of modifications of the embodiment shown in FIG. 2.

In FIG. 8, a tapering groove 41 is formed in a portion of the cylindrical outer peripheral surface 13A of the shock absorbing member 13 facing the port 23. The tapering groove 41 has a progressively increasing depth in going toward the forward end of the shock absorbing member 13. Thus, as the shock absorbing member 13 enters the shock absorbing hole 21 and closes the port 23, the tapering groove 41 provides a channel for the pressure fluid to flow to the port 23, thereby avoiding sudden deceleration of the piston. The depth of the tapering groove 41 is reduced as the shock absorbing member 13 enters the shock absorbing hole 21, so that the throttling effect increases and a good deceleration characteristic can be exhibited. Moreover, when the piston moves from its position shown in FIG. 8 leftwardly as pressure fluid is supplied through the supply and discharge passageway, pressure fluid is immediately supplied from the port 23 through the tapering groove 41 to the back pressure chamber 24. As compared with the embodiment shown in FIGS. 2 and 3 in which pressure fluid is supplied to the back pressure chamber 24 through the throttle passageway E alone, the embodiment shown in FIG. 8 is capable of quickly and smoothly effecting movement of the shock absorbing member 13, out of the shock absorbing hole 21.

Figure 9:
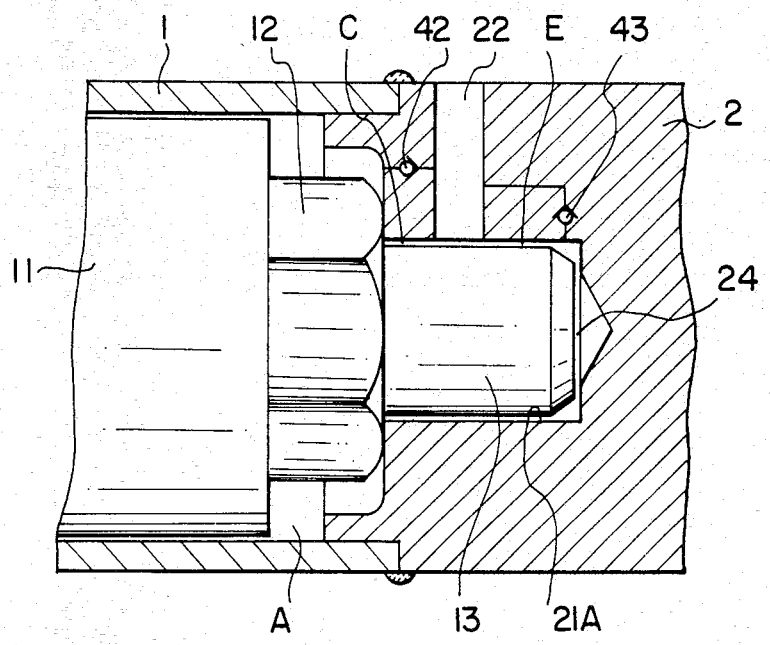

FIG. 9 shows an embodiment which comprises, in addition to the parts of the embodiment shown in FIGS. 2 and 3, a first ancillary passageway mounting a check valve 42 allowing pressure fluid to flow from the supply and discharge passageway 22 to the chamber A, and a second ancillary passageway mounting a check valve 43 allowing pressure fluid to flow from the supply and discharge passageway 22 to the back pressure chamber 24. In this embodiment also, the pressure fluid from the suction and discharge passageway 22 is fed into the chamber A and the back pressure chamber 24 through the check valves 42 and 43 respectively when the pressure fluid is supplied from the supply and discharge passageway 22 and the piston 11 has moved into an expansion stroke, to thereby enable movement of the shock absorbing member 12 out of the hole 21 to be smoothly effected.

Figure 10:
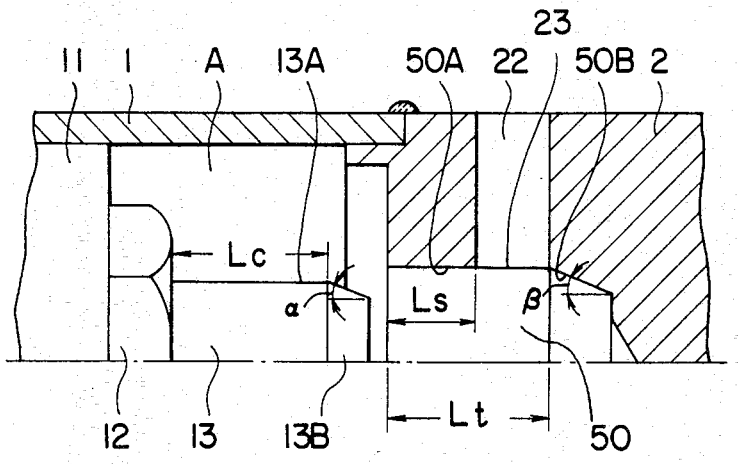
FIGS. 10 and 11 are sectional views of the shock absorbing device comprising still another embodiment mounted on the head cover side with the piston located in different operation positions.
Figure 11:
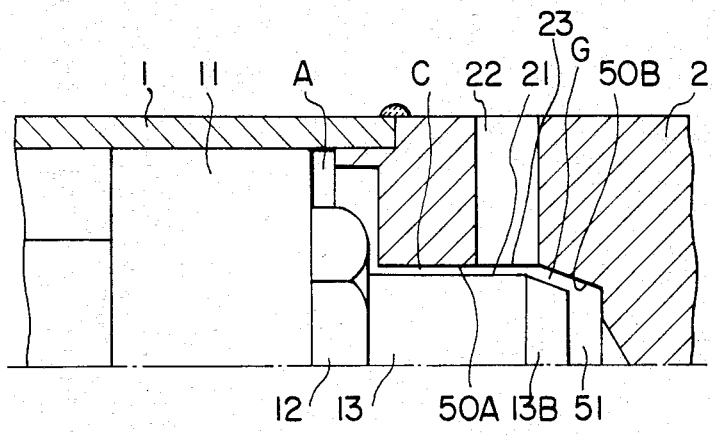

FIGS. 10 and 11 show a still another embodiment in which a shock absorbing hole 50 is defined by a cylindrical inner peripheral surface 50A and a tapering inner peripheral surface 50B extending beyond the port 23 and a back pressure chamber 51 is defined by a tapering inner peripheral surface 50B. Meanwhile the shock absorbing member 13 has a cylindrical outer peripheral surface 13A of a length Lc substantially equal to the length Lt of a cylindrical inner peripheral surface 50A and a tapering outer peripheral surface 13B at the forward end of the former. The tapering outer peripheral surface 13B operates in such a manner that it enters the back pressure chamber 51 and cooperates with the tapering inner peripheral surface 50B to define between the surfaces 13B and 50B an inclined annular gap or throttle passageway G. In operation, the rightward movement of the piston 11 causes the shock absorbing member 13 to enter the shock absorbing hole 50, to allow the throttle passageway G to perform a first stage shock absorption. The first stage shock absorption lasts while the cylindrical outer peripheral surface 13A of the shock absorbing member 13 moves in a stroke covering the distance corresponding to the length Ls of the throttle passageway. Then as the shock absorbing member 13 further moves, the area of the opening of the port 23 is gradually reduced by the cylindrical outer peripheral surface 13A of the shock absorbing member 13, to thereby perform a second stage shock absorption. At the end of the second stage shock absorption, the tapering outer peripheral portion 13B of the shock absorbing member 13 enters the back pressure chamber 51 as shown in FIG. 11, to cause a back pressure to be generated therein. At the same time, the pressure fluid in the back pressure chamber 51 flows through the throttle passageway G into the port 23, so that resistance is offered by the passageway G to the flow of the pressure fluid. Thus, the shock absorbing action performed by the throttling of the port 23 gradually by the cylindrical outer peripheral portion 13A of the shock absorbing member 13 and the shock absorbing action performed by the back pressure in the back pressure chamber 51 and the throttle passageway G are set in motion simultaneously, to thereby bring about rapid deceleration of the piston 11. At this time, as the tapering outer peripheral surface 13B of the shock absorbing member 13 nears the tapering inner peripheral surface 50B of the shock absorbing hole 50, the cross-sectional area of the throttle passageway G shows a sudden reduction and the resistance offered to the flow of the pressure fluid therethrough rapidly increases. Thus, a positive shock absorbing action can be performed to bring the piston 11 to a halt. The tapering surfaces 13B and 50B defining the throttle passageway G may be parallel to each other or angles of inclination $\alpha$ and $\beta$ may be equal to each other as shown in FIG. 10. However, the angle of inclination $\beta$ of the shock absorbing hole 50 is preferably greater than the angle of inclination $\alpha$ of the shock absorbing member 13. When $\alpha<\beta$, a thin blade orifice can be formed between the forward end of the tapering outer peripheral surface 13B of the shock absorbing member 13 and the tapering inner peripheral surface 50B of the shock absorbing hole 50, so that is is possible to offer resistance to the pressure fluid flowing through the orifice without the fluid being influenced much by the temperature and viscosity of the fluid.

Figure 12:
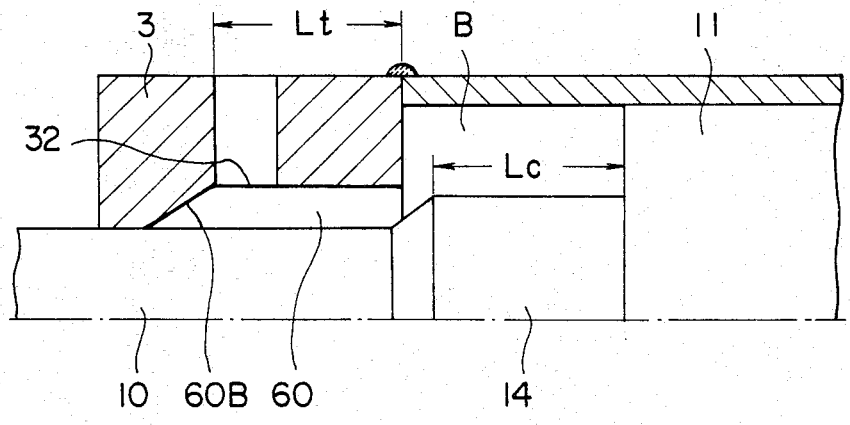
FIG. 12 is a sectional view of the shock absorbing device comprising still another embodiment mounted on the rod cover side similar to the embodiment shown in FIGS. 10 and 11.
Figure 13:
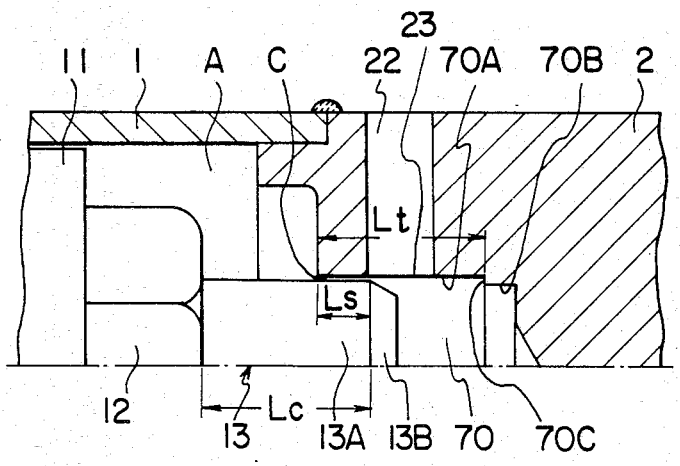
FIGS. 13–15 are sectional views of the shock absorbing device comprising still another embodiment mounted on the head cover side with the piston located in different operation positions.
Figure 14:
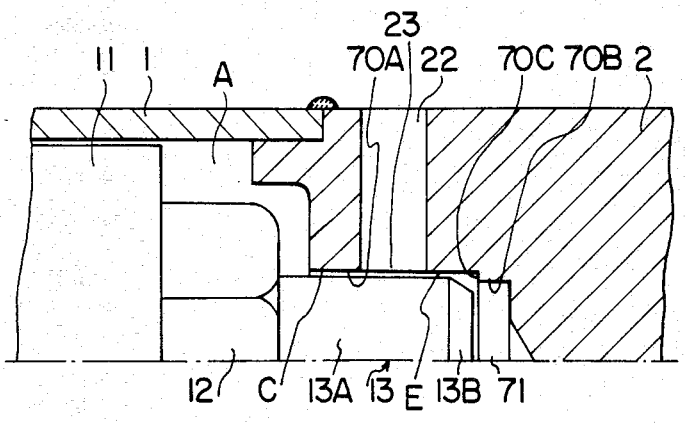
Figure 15:
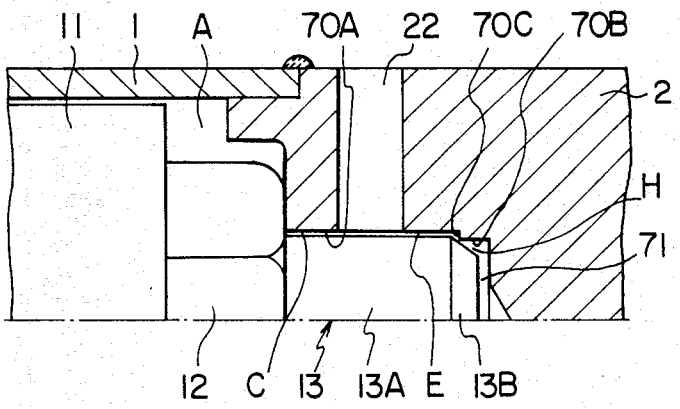

FIG. 12 shows an embodiment in which the same concept as incorporated in the embodiment shown in FIGS. 10 and 11 is incorporated in a shock absorbing device mounted on the rod cover side. In this embodiment, a tapering inner peripheral surface 60B is formed in a portion of a shock absorbing port 60 extending beyond a port 32. The operation of this embodiment is similar to that of the embodiment shown in FIG. 10 so that detailed description shall be omitted FIGS. 13, 14 and 15 show still another embodiment in which, as in the embodiment shown in FIG. 2, the shock absorbing member 13 has a cylindrical outer peripheral surface 13A and a tapering outer peripheral surface 13B, while a shock absorbing hole 70 has a cylindrical inner peripheral surface 70A and a port 23 opening in the hole 70 at the cylindrical inner peripheral surface 70A. The shock absorbing hole 70 is additionally formed with an annular stepped portion 70C disposed beyond the inner peripheral surface 70A between it and an inner peripheral surface 70B of smaller diameter than the inner peripheral surface 70A, as distinct from the shock absorbing hole 21 shown in FIG. 2. The stepped portion 70C is located in a position spaced apart from the entrance of the shock absorbing hole 70 a distance corresponding to the length Lc of the cylindrical portion of the shock absorbing member 13.

In operation, as the cylindrical outer peripheral surface 13A of the shock absorbing member 13 enters the shock absorbing hole 70, a throttle passageway C is defined between the cylindrical outer peripheral surface 13A and the inner peripheral surface 50A of the shock absorbing hole 50, so that the throttle passageway C performs a first stage shock absorption. This shock absorbing action lasts while the cylindrical outer peripheral surface 13A moves a distance corresponding to the length Ls of the throttle passageway C. Further movement of the shock absorbing member 13 causes the cylindrical outer peripheral portion 13A to gradually close the opening of the port 23, to additionally perform a shock absorbing action by the throttling of the flow of the pressure fluid through the port 23, to thereby perform a second stage shock absorption. Furthermore, as the cylindrical outer peripheral surface 13A of the shock absorbing member 13 moves past the opening of the port 23 as shown in FIG. 14, the forward end of the shock absorbing member 13 enters a back pressure chamber 71, to cause a back pressure to be generated therein. Thus, the resistance offered to the flow of the pressure fluid by the back pressure in the back pressure chamber 71 and by the throttle passageway E perform a shock absorbing action, thereby setting in motion a third stage shock absorption. When further movement of the shock absorbing member 13 brings same to a position shown in FIG. 15, an annular orifice H is defined between the tapering outer peripheral surface 13B of the shock absorbing member 14 and the stepped portion 70C of the shock absorbing hole 70. Thus, as the area of the orifice H is reduced, the back pressure in the back pressure chamber 71 rises because the latter is brought to a closed condition, to thereby offer increased resistance to the shock absorbing member 13. At the same time, the resistance offered to the flow of the pressure fluid from the back pressure chamber 71 to the throttle passageway E through the orifice H performs a shock absorbing action, thereby enabling a fourth stage or last stage shock absorption to be performed.

Figure 16:
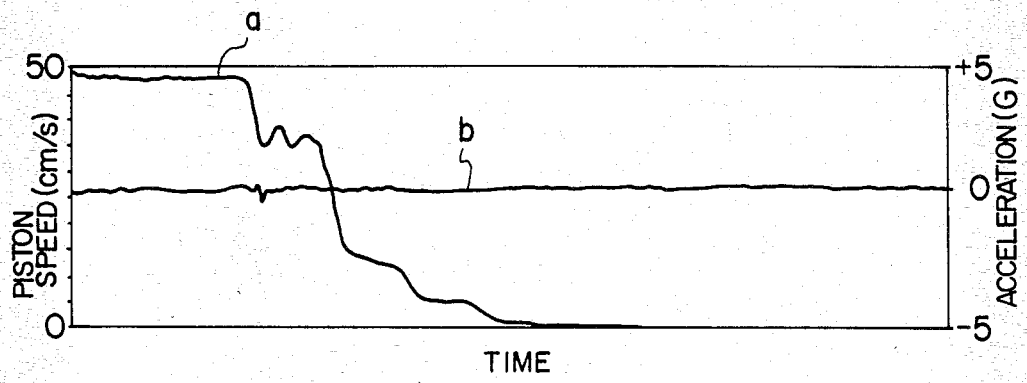
FIG. 16 is a graph showing the piston speed and the head cover acceleration of the embodiment shown in FIGS. 13–15 in the shock absorbing stroke.

As described hereinabove, in the embodiment shown in FIGS. 13–15, shock absorption is carried out in four stages, to enable smooth deceleration of the piston 11 to be obtained. FIG. 16 shows the results of actual measurements of a change in the speed of the piston and a change in the acceleration of the head cover done in the embodiment shown in FIGS. 13–15.

In the figure, a curve (a) represents the speed of the piston, and a curve (b) indicates the acceleration of the head cover. As can be clearly seen in the figure, the embodiment enables smoother deceleration of the piston 11 to be obtained than the embodiment shown in FIG. 5.

Figure 17:
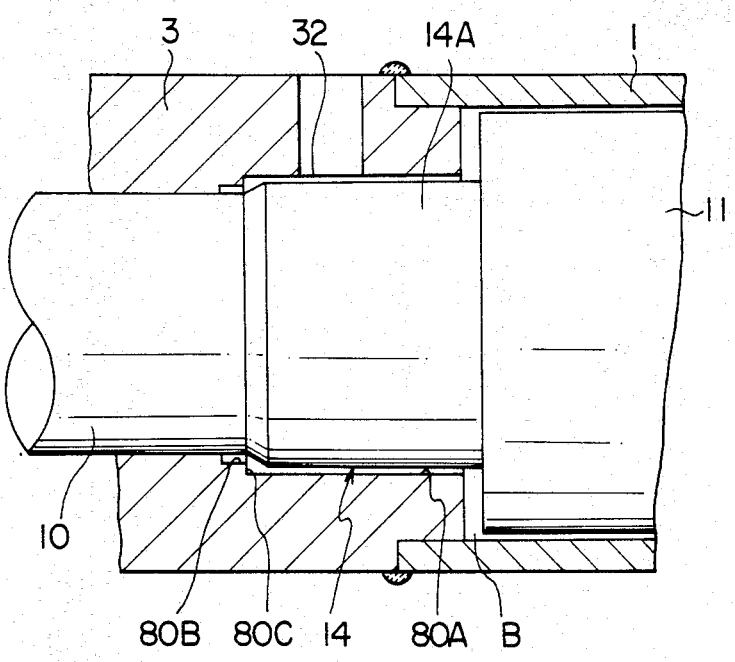
FIG. 17 is a sectional view of the shock absorbing device comprising a further embodiment mounted on the rod cover side similar to the embodiment shown in FIGS. 13–15.

The concept of the embodiment shown in FIGS. 13–15 can, of course, be incorporated in a shock absorbing device mounted on the rod cover 3 side. FIG. 17 shows an embodiment of this concept in the shock absorbing device mounted on the rod cover 3 side, in which a shock absorbing hole 80 has a cylindrical inner peripheral surface 80A of a major diameter, a cylindrical inner peripheral surface 80B of a minor diameter and a stepped portion 80C interposed therebetween. The stepped portion 80C operates in such a manner that a minuscule annular orifice is defined between the tapering outer peripheral surface 14B of the shock absorbing member 14 and the stepped portion 80C. In this embodiment also, shock absorption is performed in four stages, like the embodiment shown in FIGS. 13–15.

Figure 18:
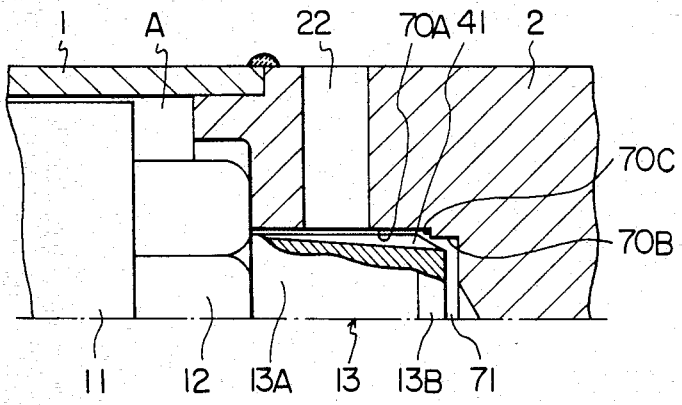
FIGS. 18 and 19 are sectional views of modifications of the embodiments shown in FIGS. 13–15.
Figure 19:
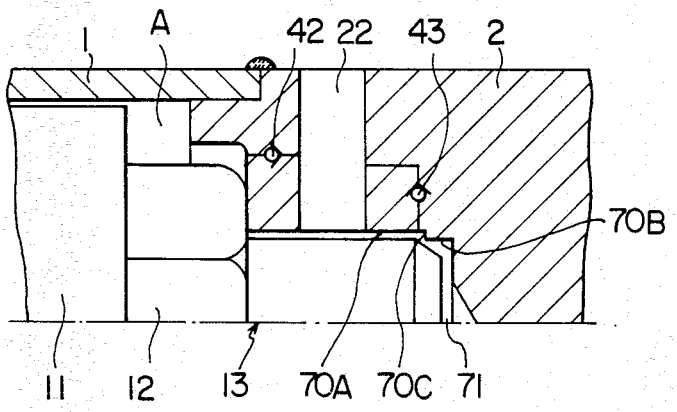

FIGS. 18 and 19 show modifications of the embodiment shown in FIG. 13. Like the embodiment shown in FIG. 8, the modification shown in FIG. 18 is formed with a tapering groove 41 in the shock absorbing member 13. In the modification shown in FIG. 19, check valves 42 and 43 are mounted in first and second ancillary passageways, as in the embodiment shown in FIG. 9. In these modifications of the embodiment, the advantage of being able to readily move the shock absorbing member 13 out of the hole is offered as described by referring to the embodiment shown in FIGS. 8 and 9.

While preferred embodiments of the invention have been shown and described hereinabove, it is to be understood that they are merely for purposes of illustration and not limiting the scope of the invention. It will be apparent that various changes and modifications may be made therein without departing from the spirit and scope of the invention which is defined in the addened claims.

What is claimed is:

1. A hydraulic cylinder comprising:

a housing including a cylindrical side wall and at least one end wall;

a piston assembly including a piston slidably arranged in said housing for sliding axial movement for cooperating with the housing to define therein a working space;

a shock absorbing device for reducing the speed of movement of the piston assembly at an end of the piston stroke, said shock absorbing device including:

means for defining a shock absorbing hole formed in the end wall and extending axially of the housing, passageway means communicating with the shock absorbing hole through a port to discharge hydraulic fluid in said working space, said port being formed in an inner peripheral surface of said shock absorbing hole at a position spaced apart from an end of said shock absorbing hole remote from said working space so that a back pressure chamber is defined by said inner peripheral surface between said port and said end of the shock absorbing hole, and a shock absorbing member mounted on said piston assembly in substantial alignment with said shock absorbing hole and adapted to enter said shock absorbing hole at the end of the piston stroke, said shock absorbing member cooperating with said inner peripheral surface of said hole to define annular gaps of substantially equal areas directly adjacent opposite sides of said port and an orifice between said port and said end of the shock absorbing hole and throttling said port at the extreme end of the piston stroke, said inner peripheral surface of the shock absorbing hole and said shock absorbing member being configured such that the area of said orifice becomes smaller as the piston approaches an end of the stroke whereby the flow rate of the hydraulic fluid discharged from said back pressure chamber through said orifice to said port is increasingly restricted thereby improving the shock absorbing effect prior to a reaching of the end of the stroke.

2. A hydraulic cylinder as claimed in claim 1, wherein said inner peripheral surface of said shock absorbing hole comprises a cylindrical inner peripheral surface having opposite ends, said port being located on the cylindrical inner peripheral surface at a position spaced apart from the opposite ends, and said shock absorbing member has a cylindrical outer peripheral surface of a diameter slightly smaller than the diameter of said inner peripheral surface of said shock absorbing hole.

3. A hydraulic cylinder as claimed in claim 1, wherein said shock absorbing member has a cylindrical outer peripheral surface of a diameter slightly smaller than a diameter of said inner peripheral surface of said shock absorbing hole.

4. A hydraulic cylinder comprising:

a housing including a cylindrical side wall and at least one end wall;

a piston assembly including a piston slidably arranged in said housing for sliding axial movement for cooperating with the housing to define therein a working space;

a shock absorbing device for reducing the speed of movement of the piston assembly at an end of the piston stroke, said shock absorbing device including:

means for defining a shock absorbing hole formed in an end wall and extending axially of the housing, passageway means communicating with the shock absorbing hole through a port to discharge hydraulic fluid in said working space, said port being formed in an inner peripheral surface of said shock absorbing hole at a position spaced apart from an end of said hole remote from said working space so that a back pressure chamber is defined by said inner peripheral surface between said port and said end of the hole, the inner peripheral surface defining said back pressure chamber includes a cylindrical surface portion adjacent said port, and a stepped surface portion contiguous therewith, and a shock absorbing member mounted on said piston assembly in substantial alignment with said shock absorbing hole and adapted to enter said hole at the end of the piston stroke, said shock absorbing member cooperating with said inner peripheral surface of said hole to define annular gaps on opposite sides of said port and throttling said port at the extreme end of the piston stroke, said shock absorbing member including a cylindrical outer peripheral surface portion adapted to enter said cylindrical surface portion to define an annular gap therebetween, and a tapering surface portion contiguous with said cylindrical outer peripheral surface portion, said tapering surface portion being adapted to cooperate with said stepped surface portion to define therebetween an annular gap.

5. A hydraulic cylinder as claimed in one or more of claims 1, 2, or 4, wherein said shock absorbing member is formed at a portion of the outer peripheral surface thereof facing said port with a tapering groove extending axially of the shock absorbing member, said tapering groove having a cross-sectional area progressively increasing and going toward the end of said shock absorbing member adjacent said back pressure chamber.

6. A hydraulic cylinder as claimed in any one of claims 1, 2, or 4, further comprising a first ancillary passageway communicating said passageway means with said working space and mounting a one-way valve allowing the fluid to flow from said passageway means to said working space, and a second ancillary passageway communicating said passageway means with said back pressure chamber and mounting a one-way valve allowing the fluid to flow from said passageway means to said back pressure chamber.

* * * * *